US005122010A

United States Patent [19]

Burguieres, Jr. et al.

[11] Patent Number: 5,122,010

[45] Date of Patent: Jun. 16, 1992

[54] OFFSHORE PLATFORM STRUCTURE

[76] Inventors: Sam T. Burguieres, Jr., 1402 N. Causeway, Apt. 311; Steven G. Haller, 115 Century Oak La., both of Mandeville, La. 70448; Preston A. Price, 151 Country Club Dr., Covington, La. 70433

[21] Appl. No.: 581,690

[22] Filed: Sep. 13, 1990

[51] Int. Cl.[5] ..... E02B 17/00

[52] U.S. Cl. ..... 405/204; 405/205; 405/209; 405/224; 405/227

[58] Field of Search ..... 405/195, 203, 204, 205, 405/207, 209, 224, 225, 227

[56] References Cited

U.S. PATENT DOCUMENTS

| | | | |
|---|---|---|---|
| Re. 30,823 | 12/1981 | Guy et al. | 405/204 |
| Re. 30,825 | 12/1981 | Guy et al. | 405/204 |
| 2,637,978 | 5/1953 | Evans et al. | 61/46 |
| 2,653,451 | 9/1953 | McCullough | 61/46 |
| 2,775,095 | 12/1956 | Harris | 405/204 |
| 2,927,435 | 3/1960 | Upson | 61/46 |
| 3,306,052 | 2/1967 | Kawasaki | 61/46.5 |
| 3,372,745 | 3/1968 | Holmes . | |
| 3,390,531 | 7/1968 | Johnston et al. | 61/46 |
| 3,516,259 | 6/1970 | Tokola | 61/46.5 |
| 3,524,322 | 8/1970 | Pogonowski | 61/46.5 |
| 3,546,885 | 12/1970 | Pogonowski | 61/46.5 |
| 3,556,210 | 1/1971 | Johnson | 166/0.5 |
| 3,572,044 | 3/1971 | Pogonowski | 61/46.5 |
| 3,638,436 | 2/1972 | Pogonowski . | |
| 3,641,774 | 2/1972 | Hekkanen et al. . | |
| 3,716,994 | 2/1973 | Pogonowski . | |
| 3,839,872 | 10/1974 | Loire . | |
| 3,852,969 | 12/1974 | Gibson et al. . | |
| 3,876,181 | 4/1975 | Lucas | 254/107 |
| 3,946,568 | 3/1976 | Heien . | |
| 4,000,624 | 1/1977 | Chow . | |
| 4,018,057 | 4/1977 | Erzen et al. . | |
| 4,063,426 | 12/1977 | Hansen . | |
| 4,106,302 | 8/1978 | Vogel . | |
| 4,109,476 | 8/1978 | Gracia . | |
| 4,170,431 | 10/1979 | Wood | 405/202 |
| 4,181,452 | 1/1980 | Pagezy et al. | 405/203 |
| 4,297,964 | 11/1981 | Oleborg | 114/263 |
| 4,553,878 | 11/1985 | Willemse et al. | 405/203 |
| 4,557,629 | 12/1985 | Meek et al. | 405/204 |
| 4,558,973 | 12/1985 | Blandford | 405/216 |
| 4,607,983 | 8/1986 | Meek et al. | 405/204 |
| 4,609,046 | 9/1986 | Schawann et al. | 166/341 |
| 4,616,708 | 10/1986 | da Mota | 166/355 |

(List continued on next page.)

OTHER PUBLICATIONS

"Minimal Platforms Booming in Shallow U.S. Gulf Waters", Jeff Littleton, Offshore Incorporating The Oil Man, Nov. 1988, PennWell Publication, pp. 22-26.

*Primary Examiner*—Dennis L. Taylor
*Assistant Examiner*—John Ricci
*Attorney, Agent, or Firm*—C. Emmett Pugh

[57] ABSTRACT

A relatively light-weight offshore structure with design characteristics that allow it to be installed in a water depth up to two hundred fifty (250') feet with a conventional jack-up drilling rig or a small derrick barge. The structure consists of one (1) vertical pipe column that is driven into the sea floor, which can be used as a conductor for a well and may also support a platform with wellhead deck, production equipment deck, heliport, etc. The vertical column is collar clamped and welded to a submerged support brace assembly. The brace assembly is rigid, light, floats during installation, and is self-uprighting. It consists of two (2) main diagonal support legs that are connected to the vertical column near the water-line, and has two (2) pile connection sleeves at its base for piles to be driven into the sea floor. The support piling may be pre-loaded into the support brace assembly for ease of offshore installation. The piles are rigidly attached to the brace assembly pile sleeves with clamps and/or grout after driving. The completed structure may support additional well conductors installed parallel to the main vertical pipe column. Due to the platform design characteristics, it has the flexibility of being removable with a drilling rig and to be easily salvaged for future use at another location.

3 Claims, 9 Drawing Sheets

OTHER PUBLICATIONS

| | | | |
|---|---|---|---|
| 4,646,841 | 3/1987 | Schawann et al. | 166/355 |
| 4,669,917 | 6/1987 | Sveen | 405/227 |
| 4,679,964 | 7/1987 | Blandford | 405/216 |
| 4,687,380 | 8/1987 | Meek et al. | 405/204 |
| 4,688,967 | 8/1987 | Einstabland et al. | 405/222 |
| 4,702,321 | 10/1987 | Horton | 166/350 |
| 4,740,107 | 4/1988 | Casbarian et al. | 405/211 |
| 4,761,094 | 8/1988 | Turner | 405/204 |
| 4,812,080 | 3/1989 | Urquhart et al. | 405/227 |
| 4,818,145 | 4/1989 | Carruba | 405/203 |
| 4,824,291 | 4/1989 | Coppens | 405/204 |
| 4,842,446 | 6/1989 | Carruba | 405/227 |
| 4,854,778 | 8/1989 | Valenzuela | 405/204 |
| 4,907,657 | 3/1990 | Cox | 175/9 |
| 4,983,074 | 1/1991 | Carruba | 405/227 |
| 5,042,960 | 8/1991 | Tawfik et al. | 405/227 |
| 5,051,036 | 9/1991 | Gomez de Rosas et al. | 405/227 |

OFFSHORE PLATFORM STRUCTURE

BACKGROUND OF INVENTION

1. Field of Invention

The present invention relates to relatively light weight offshore support structures and installation methods, specifically in which a vertical pipe column extending from the ground below to above the surface of the water is braced by a support assembly structure.

The preferred embodiment of the present invention includes a, support brace assembly configured to communicate with a vertical pipe column, said support brace assembly comprising two main inclined and radially spaced tubular legs, the upper ends of which, approximately five feet (5') to ten feet (10') below the water surface, are rigidly connected to a segment of a vertical pipe sleeve designed to be placed around the top of the pipe column, and the lower ends of which are rigidly connected to separate pile sleeves at the mud-line. Further, to provide an intermediate brace point to the pipe column, two inclined and radially spaced tubular braces extend from a hinged collar clamp around the vertical pipe column at their upper ends, located at approximately mid-height between the mud-line and the water surface, to rigid connections with the main tubular legs at the mud-line. Further, a vertical tubular member is located parallel to the pipe column, and rigidly connects to the pipe sleeve and main tubular legs at its upper end, and to the hinged collar clamp and tubular braces at its lower end. Secondary rigid tubular horizontals, diagonal braces, and a horizontal member at the mud-line, between the base of the main tubular legs and pile sleeves, complete the support brace assembly framing.

2. Prior Art & General Background

A list of prior patents which may be of interest is presented below:

| U.S. Pat. No. | Patentee(s) | Issue Date |
|---|---|---|
| 2,637,978 | J. R. Evans et al | May 12, 1953 |
| 2,653,451 | S. E. McCullough | Sept. 29, 1953 |
| 2,927,435 | M. M. Upson | Sept. 23, 1956 |
| 3,306,052 | Masasuke Kawasaki | Feb. 28, 1967 |
| 3,372,745 | B. G. Holmes | March 12, 1968 |
| 3,390,531 | L. P. Johnson et al | July 2, 1968 |
| 3,516,259 | A. J. Tokola | June 23, 1970 |
| 3,524,322 | I. C. Pogonowski | Aug. 18, 1970 |
| 3,546,885 | I. C. Pogonowski | Dec. 15, 1970 |
| 3,556,210 | Vincent C. Johnson | Jan. 19, 1971 |
| 3,572,044 | I. C. Pogonowski | Mar. 23, 1971 |
| 3,638,436 | Pogonowski | Feb. 1, 1972 |
| 3,641,774 | Hekkanen et al | Feb. 15, 1972 |
| 3,716,994 | Pogonowski | Feb. 20, 1973 |
| 3,839,872 | Loire | Oct. 8, 1974 |
| 3,852,969 | Gibson et al | Dec. 10, 1974 |
| 3,876,181 | Lucas | Apr. 8, 1975 |
| 3,946,568 | Heien | Mar. 30, 1976 |
| 4,000,624 | Chow | Jan. 4, 1977 |
| 4,018,057 | Erzen et al | Apr. 19, 1977 |
| 4,036,426 | Hansen | Dec. 20, 1977 |
| 4,106,302 | Vogel | Aug. 15, 1978 |
| 4,109,476 | Gracia | Aug. 29, 1978 |
| 4,170,431 | Wood | Oct. 9, 1979 |
| 4,181,452 | Pagezy et al | Jan. 1, 1980 |
| 4,297,964 | Oleborg | Nov. 3, 1981 |
| 4,553,878 | Willemse et al | Nov. 19, 1985 |
| 4,557,629 | Meek et al | Dec. 10, 1985 |
| 4,558,973 | Blandford | Dec. 17, 1985 |
| 4,607,983 | Meek et al | Aug. 26, 1986 |
| 4,609,046 | Schawann | Sep. 2, 1986 |
| 4,616,708 | da Mota | Oct. 14, 1986 |
| 4,646,841 | Schawann et al | Mar. 3, 1987 |

-continued

| U.S. Pat. No. | Patentee(s) | Issue Date |
|---|---|---|
| 4,669,917 | Sveen | Jun. 2, 1987 |
| 4,679,964 | Blandford | Jul. 14, 1987 |
| 4,687,380 | Meek et al | Aug. 18, 1987 |
| 4,688,967 | Einstabland et al | Aug. 25, 1987 |
| 4,702,321 | Horton | Oct. 27, 1987 |
| 4,740,107 | Casbarian et al | Apr. 26, 1988 |
| 4,761,097 | Turner | Aug. 2, 1988 |
| 4,812,080 | Urquhart et al | Mar. 14, 1989 |
| 4,818,145 | Carruba | Apr. 4, 1989 |
| 4,842,446 | Carruba | Jun. 27, 1989 |
| 4,854,778 | Valenzuela | Aug. 8, 1989 |
| 4,907,657 | Cox | Mar. 13, 1990 |
| RE 30,823 | Guy et al | Dec. 15, 1981 |
| RE 30,825 | Guy et al | Dec. 15, 1981 |

The following publication is also referenced:

"Minimal platforms booming in shallow U.S. gulf waters", Jeff Littleton, *Offshore (Incorporation THE OILMAN)*, November, 1988 (PennWell Publications 1988), Pages 22–28, 26 and figures.

The prior art, both as disclosed in U.S. patents and in industry practice, has pursued reduced cost means of supporting single or multiple (e.g. 2 to 4) well production structures in the offshore environment in relatively shallow (e.g. 50' to 250') water depths. Reduced costs of placing wells into production may make possible the economic production of marginal wells and fields, heretofore considered uneconomical.

A well conductor pipe and well casings and tubings are usually installed by a jack-up type drilling rig in water depths up to two hundred and fifty (250') feet. The drilling rig is required for both drilling the well and for completing and preparing the well for production. Well conductor pipes are usually sized in the range of twenty-four (24") to forty-eight (48") inches in diameter, but are not capable of safely free-standing in over thirty (30',) to fifty (50') feet of water for any extended period of time, much less support a deck, helideck, etc., required for production of the well(s). In a typical installation, a relatively large and heavy support structure and platform are installed by a derrick barge after initial exploratory well drilling, and then subsequent re-mobilization of a drilling rig is required to complete the well(s).

Alternatively, a number of light support structure systems have been proposed to reduce time, cost, and to enhance the possibility that the jack-up drilling rig can be used for the complete structure installation. Several prior art methods make use of a single vertical pipe column as a principal support member, typically also used as a well conductor pipe. Such alternative type structures have been proposed and utilized, but most require extensive underwater diver installation work, or have been relatively flexible and produced objectionable movement, or have been very difficult or impossible to install with a jack-up drilling rig in water depths in the range of a hundred to two hundred and fifty feet (100'–250').

U.S. Pat. No. 4,558,973 is one such support structure, but has decided disadvantages. It requires four (4) or more pilings around the base of the structure, none of which are pre-installed in the structure. The structure is either split so as to clamp around the well conductor pipe, requiring extensive underwater installation work, or must be lifted completely out of the water for installation over the top of the conductor. The structure has extensive base mud-line framing, and is difficult or impossible to install with a conventional jack-up drilling rig in water depths over a hundred and twenty (125') feet.

U.S. Pat. No. 4,679,964 offers additional details and alternate embodiments of the above patent, as a continuation-in-part. Alternate means of connecting support piles, boat landings and decks, and mud-line framing members are presented. Alternate embodiments describe stacked structure sections, dual well caisson systems, and various cable stayed structures.

U.S. Pat. No. 4,687,380 discloses a structure comprised of a central column with three diagonal support legs and base connected piling. The three support legs are sleeve connected to the column to provide both lateral and vertical support. This structure system requires extensive underwater installation work, with dependency only on grouted column and pile connections. Piling are not pre-installed, and installation is difficult or impossible with a drilling rig in greater than a hundred and twenty to a hundred and fifty foot (125'-150') water depth.

U.S. Pat. No. 4,740,107 describes a structural system whereby two prefabricated sleeve and bracing assemblies, one above the water surface incorporating a boat landing, and one at the mud-line, are connected to a well caisson. Two or more vertical piling are driven into the bottom soil through sleeves in both assemblies, and connected to these sleeves to form a straight legged structure. This system is limited to approximately one hundred and twenty-five (125') feet or less water depth.

U.S. Pat. No. 4,818,145 discloses two (2) different types of support structures, both utilizing a well conductor pipe as one of three (3) supports at the mud-line. Two (2) pilings are added to form a three legged structure, and in this latter aspect has some similarity to the present invention. However, both structure types of the '145 patent have disadvantages. The first structure requires that the two added piling and structure legs extend to above the water surface, and requires difficult clamping to the well conductor pipe below water. Friction-type bolted clamps of tubular joints to underwater pipes have proven to give poor structural performance as well as installation difficulty. This structure is also relatively heavy, and difficult or impossible to install with a conventional drilling rig in water depths over seventy-five (75') to a hundred (100') feet.

The second of these support structures utilizes two (2) separate tubular braces hinges (pivotally) connected above the water to the well conductor pipe, and a hinge (pivotally) connected at the mud-line to two (2) separate piling. These types of hinge connections have proven to cause high structural flexibility, maintenance problems, and difficulty in installation. This system is limited in application for drilling rig installation to less than one hundred and twenty-five (125') to a hundred and fifty (150') foot water depths, and does not permit pre-loading of the piling.

U.S. Pat. No. 4,842,446 is a continuation-in-part of the preceding patent, and provides further details on both systems previously described. Alternate bracing configurations are described, with the purpose of reducing the amount of mud-line framing and diver work during installation. Both structure types continue to be limited in water depth application with drilling rig installation, as well as requiring difficult hinged or bolted connections.

A recent improvement to the above patents, presented in the industry by the same inventor, utilizes a totally submerged, two legged support structure, with two pilings connected at the mudline. The design, however, continues to have the disadvantages of difficult installation of bolted underwater clamps, extensive mud-line framing, inability to pre-load the piling, and very difficult or impossible drilling rig installation in the hundred and fifty (150') to two hundred and fifty (250') foot water depth range.

U.S. Pat. No. 4,812,080 discloses a structure with a vertical column braced by two inclined piles pre-loaded in a brace and sleeve assembly. This system requires difficult underwater connections, has piles which extend permanently above the water-line, and is difficult for drilling rig installation. Water depth range is limited to a maximum of a hundred (100') to a hundred and twenty-five (125') feet.

U.S. Pat. No. 4,854,778 discloses a structural system wherein a central tubular column is braced near its base by three vertical piles, braced by a template assembly to that column. This system is limited in water depth to approximately one hundred and twenty-five to one hundred and fifty (125-150') feet, and would be difficult to install with a drilling rig after a well is drilled.

U.S. Pat. No. 4,907,657 teaches of a structure very similar to that of U.S. Pat. No. 4,740,107 described above, but eliminates the lower (mud-line) prefabricated sleeve and bracing assembly. The structure is limited to much shallower water depths, in the range of fifty (50') to seventy-five (75') maximum depth.

A breasting dolphin type support structure, recently employed for relatively small offshore platforms, utilizes two inclined pilings connected to the well conductor pipe above the water-line using pile sleeves integrated with a boat landing structure. This unpatented system is limited to a maximum of a hundred foot (100') water depth, and is difficult for a drilling rig installation.

Submerged tripod and four-legged structures have also been utilized in the industry. These structures have not used the well conductor pipe as a principal support member, and are difficult or impossible to install by a drilling rig in any but relatively shallow (less than 100') water depths.

Relative the *OILMAN* reference, note in particular the "MOSS I" and "MOSS II" references as exemplified in the illustrations on page 26 of the article, wherein two alternated designs illustrate a minimal platform support structure not shown in the other prior art, but nonetheless readily distinguishable in design and implementation when compared to the present invention. Besides the structural differences associated with the present invention, the MOSS designs are configured to be installed in a manner wholly inconsistent in comparison with the present method.

Thus, in contrast to the present invention, there have been no offshore support structures which can be installed simply and inexpensively in up to two hundred and fifty foot (250') water depths with a conventional drilling rig, with a minimum of underwater installation work, and with the ability to pre-load support piling.

General, Summary Discussion of the Invention

The present invention provides significant advancements in the art, and overcomes the disadvantages and limitations of the existing art previously described, in several embodiments and methods. These will be summarized below, and subsequently described in detail.

The principal embodiment of the invention begins with a vertical pipe column located offshore, in as deep as two hundred and fifty (250') feet of water, extending from below the mudline, below a body of water, to approximately ten (10') to fifteen (15') feet above the water. This pipe column can be used as a well conductor pipe.

The pipe column diameter would range from thirty (30") to seventy-two (72") inches, depending on the strength required to freestand temporarily during installation of the structural system and to function as one leg of the subsequently completed structure. The pipe column would be driven or otherwise installed into the ground with a sufficient, pre-designed penetration.

A prefabricated support brace assembly is brought to the site offshore and installed on the pipe column. This support brace assembly consists of two main inclined and radially spaced tubular legs, the upper ends of which, five (5') to ten (10') feet below the water surface, are rigidly connected to a segment of vertical pipe sleeve designed to be placed around the top of the pipe column, and the lower ends of which are rigidly connected to separate pile sleeves at the mud-line.

Further, to provide an intermediate brace point to the pipe column, two inclined and radially spaced tubular braces extend from a hinged collar clamp around the vertical pipe column at their upper ends, located at approximately mid-height between the mud-line and the water surface, to rigid connections with the main tubular legs at the mud-line.

Additionally, a vertical tubular member is located parallel to the pipe column, and rigidly connects to the pipe sleeve and main tubular legs at its upper end, and to the hinged collar clamp and tubular braces at its lower end. Secondary rigid tubular horizontals, diagonal braces, and a horizontal member at the mud-line, between the base of the main tubular legs and pile sleeves, complete the support brace assembly framing.

A mudmat is located at the base of the assembly for temporary support on the bottom soil until the support piles are driven and connected to the pile sleeves. The upper vertical pipe sleeve may have a boat landing pre-installed on it, either rigidly or clamped in temporary position. Further, temporary pile support guides may be installed on the boat landing and/or upper vertical pipe sleeve to facilitate installation of the two support piling, and the two support piling may be pre-installed in the brace structure.

The support brace assembly, once installed on the vertical pipe column, has support piling driven into the bottom soil and connected with friction clamps and/or grout to the pile sleeves at mud-line. Friction pile clamps may be pre-installed. The top of the brace assembly is firmly connected to the pipe column by welding at the top of the vertical pipe sleeve, above water, and possibly also by grouting between the pipe column and pipe sleeve.

Important features of the preferred embodiment of the present invention are outlined below.

Once installed, it can support a platform with wellhead deck, equipment deck, helideck, and associated production equipment, or can simply be used as a well protector or similar structure. The completed structure has relatively few members, standard construction materials, and few connections to make during fabrication and installation.

The boat landing, two support piling, and friction pile clamps can be pre-installed/loaded on the prefabricated support brace assembly to simplify field installation. The structure has minimum area for wind and wave environmental loading near and above the water-line, since all of the brace assembly framing preferably is submerged in the completed installation. The structure may also support additional vertical pipe columns (or well conductors) adjacent to the main pipe column.

The preferred embodiment of the present invention includes a method of installing the above described brace assembly and piling to support a vertical pipe column in a body of water, with particular emphasis on the ability to perform the procedure with a jack-up type drilling rig if desired. This aspect of the invention includes the following steps:

(a) the vertical pipe column is installed in the body of water by driving, or by other means, into the bottom soil;

(b) with the vertical pipe column temporarily freestanding (bracing to a drilling rig or other installation equipment may be utilized), the prefabricated brace assembly is brought to the offshore site, and the brace assembly, with pre-loaded boat landing and piling and friction clamps as desired, is lifted off the transportation barge by the drilling rig;

(c) the brace assembly is then lowered into the water, where upon it floats due to the buoyancy of closed tubular members, and the brace assembly is re-rigged for subsequent uprighting and installation on the pipe column (rigging may be pre-installed);

(d) particular tubular members in the brace assembly are allowed to fill with water, causing the bottom end of the assembly to sink, and the entire brace assembly to self-upright; the hinged collar clamp at mid-height is brought loosely against the pipe column, the upper vertical pipe sleeve is lowered over the top of the pipe column, and then the hinged collar clamp is closed at mid-height, using divers;

(e) the brace assembly is lowered further until its mudmat rests on the bottom soil, and the top end may be temporarily connected to the top of the vertical pipe column;

(f) the two support piling are next driven or otherwise installed into the bottom soil, and connected to the pile sleeves with bolted friction pile clamps on tops of the pile sleeves, and/or with grout between the piles and the inside of the sleeves;

(g) the connection from the vertical pipe column to the pipe sleeve, above water, is now welded with a conventional shim type connection; and the space between the pipe column and the inside of the pipe sleeve may also be filled with grout; and the erection of any supported platform, etc., may now proceed; and (h) the boat landing is permanently installed, and any temporary support pile guides or other installation aids are removed; platform installation is completed.

Removal of the present invention at the end of need in its initial location can be accomplished also with a drilling rig, or small derrick barge. The use of a drilling rig, otherwise required to plug and abandon depleted well(s), could lead to significant cost savings. A method similar, though in reverse, of the above described installation procedure, could be utilized.

An alternate embodiment of the present invention involves its application in shallower water depths, one hundred and forty (140') foot of depth and less. The hinged collar clamp at mid-height of the vertical pipe column, and associated vertical, horizontal, and bracing members are eliminated to form a "single tier" structure. The prefabricated support brace assembly then simply includes two radial inclined tubular legs, a segment of vertical pipe sleeve at the upper end to be placed over the vertical pipe column, and two pile sleeves with friction pile clamps, a horizontal tubular mud-line brace, and a mudmat at the bottom end. Other design features and the general method of installation and removal are the same as for the preferred embodiment.

A single-tiered embodiment of the present invention is that both the preferred embodiment structure (with mid-depth hinged collar clamp to form a two-tiered structure), and the single tiered alternate embodiment for shallower water, may be installed by a derrick barge or jack-up work boat with crane, other than the drilling rig that may be installing a well through or adjacent to the main vertical pipe column. In such cases, the configuration of certain components of the structures may be modified to suit the installation equipment.

A significant major modification could be the use of vertical pile sleeves at the mud-line, in anticipation of driving vertical non-preloaded piling directly over the pile sleeves with a pile follower or underwater hammer. This modification would simplify the main tubular leg to pile sleeve connections, eliminating the need for an offset at these locations. Temporary pile guides at the top end of the support brace assembly would also not be necessary. Other aspects of the structures and their installation and removal methods would be similar to those of the preferred embodiment.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

Figure 1A:
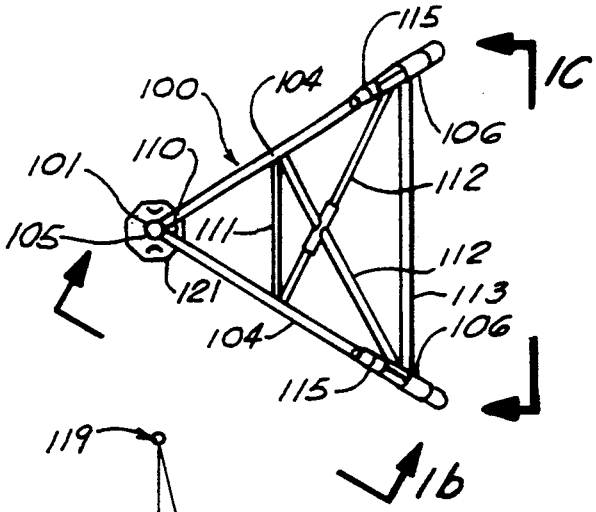
FIG. 1A is a plan view of a first, exemplary, preferred structure in accordance with the present invention.
Figure 1B:
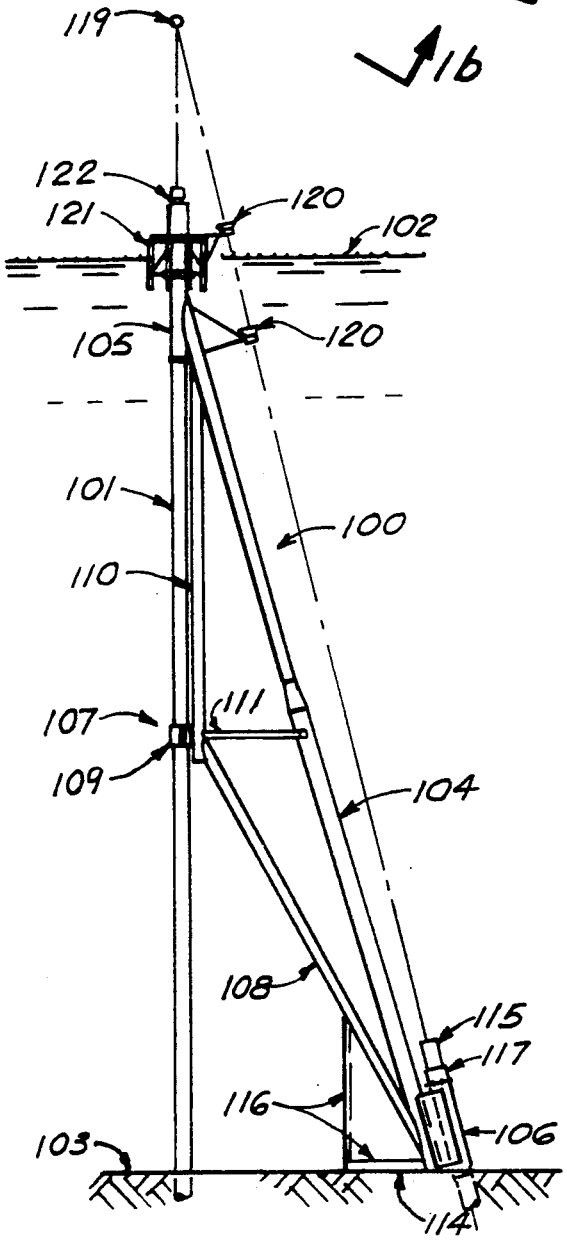
FIG. 1B is a side view of the structure shown in FIG. 1A.
Figure 1C:
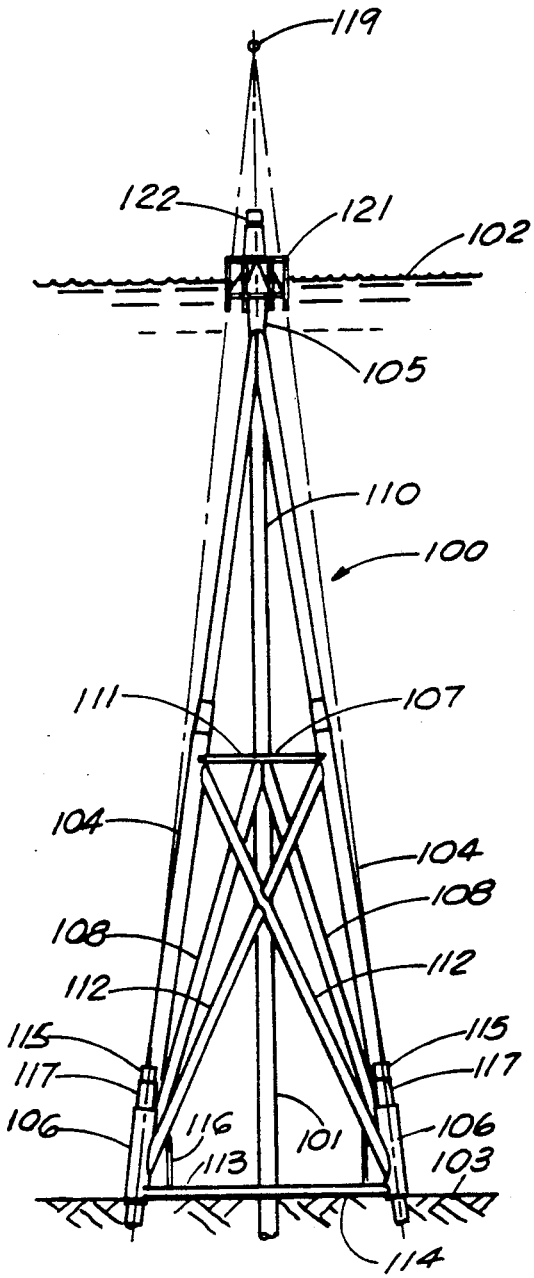
FIG. 1C is a front view of the structure shown in FIG. 1A.

The present invention, with preferred and alternate embodiments, will be described using the above listed figures. It should be understood, however, that these figures are not intended to limit the scope or application of the invention. On the contrary, these figures depict only typical embodiments, and the invention is intended to include all alternatives, modifications, and equivalents as may be applicable in the spirit and scope of the invention as defined by the appended claims.

DETAILED DESCRIPTION OF THE PREFERRED, EXEMPLARY EMBODIMENTS

The initial, preferred, exemplary embodiment of the present invention, as illustrated in FIGS. 1 through 5, constitutes a support brace assembly 100 used to support a vertical pipe column (well conductor) 101 in a body of water 102, in depths as great as two hundred and fifty feet (250') or more. The vertical pipe column (well conductor) 101 is typically tubular steel, typically ranging from thirty (30") to seventy-two (72") diameter, driven or otherwise disposed into the bottom soil 103 at its bottom end, and extending above the water surface 102 a distance of, for example, ten (10') to fifteen (15') to feet at its top end.

The vertical pipe column 101 penetrates the bottom soil 103 sufficiently to support any well loads, and also function as one leg of the subsequently completed structure. The vertical pipe column 101 must also be strong enough to free-stand temporarily until the support brace assembly 100 is installed.

The prefabricated support brace assembly 100, typically constructed of tubular steel members, consists of two (2) main inclined and radially spaced [preferably at sixty (60) degrees]legs 104, the upper ends of which, about five (5') to ten (10') below the water-line 102. are rigidly connected to a segment of vertical pipe sleeve 105. This pipe sleeve 105 is slightly larger in diameter than the vertical pipe column 101, and is designed to slip over the top or otherwise be disposed around the top of the vertical pipe column 101.

The lower ends of the main tubular legs 104 are rigidly connected to two (2) separate tubular pile sleeves 106 at the mud-line 103. Further, to provide an intermediate brace point 107 to the vertical pipe column 101, in cases of water depth in excess of a hundred and twenty-five (125') to a hundred and fifty (150') feet, two (2) inclined and radially spaced tubular braces 108 extend from a hinged collar clamp 109 around the vertical pipe column 101 at their upper end, located approximately mid-depth between the water surface 102 and the mud-line 103, to rigid connections with the main tubular legs 104 at the mud-line 103.

The hinged collar clamp 109 fits loosely around the vertical pipe column 101 to provide lateral support only. Further, a vertical tubular member 110, parallel and offset from the vertical pipe column 101, connects rigidly with the pipe sleeve 105 and the main tubular legs 104 at is upper end, and to the hinged collar clamp 109 and the tubular braces 108 at its lower end.

Three (3) secondary horizontal tubular members 111 rigidly connect to the upper ends of the tubular braces 108, the hinged collar clamp 109, and the lower end of the vertical tubular member 110, and to the mid-depth point of each of the main tubular legs 104. Two (2) additional secondary diagonal tubular braces 112 rigidly connect to the mid-depth point of each main tubular leg 104 and to the opposite main tubular leg at the mudline 103. A horizontal tubular member 113 at the mud-line 103 rigidly connects to the bottom of each main tubular leg 104, at the connection to the pile sleeves 106.

The foregoing described members complete the framing of the support brace assembly 100.

A mudmat 114 is incorporated with the support brace assembly 100 at mud-line 103. This mudmat 114 is designed to temporarily support the support brace assembly 100 on the bottom soil until it is firmly connected to the vertical pipe column 101 near the water-line 102, and to two (2) tubular piling 115 driven through the pile sleeves 106 at the mud-line 103. The mudmat 114 is framed and connected to the support brace assembly 100 with the mud-line horizontal tubular member 113 and secondary members 116.

The support brace assembly 100 is permanently supported at the mud-line 103 by two (2) tubular piling 115 driven or otherwise disposed into the bottom soil 103 through the pile sleeves 106. The piling 115 are rigidly connected to the pile sleeves 106 by means of bolted friction pile clamps 117 and/or cement grout pumped into the annulus 118 (see FIGS. 4A and 4B) between the piling 115 and pile sleeves 106.

It is recommended that both the bolted friction pile clamps 117, and the cement grouted annulus 118 in the pile sleeves 106, each be adequate for full load transfer from the support brace assembly 100 to the piling 115.

The use of both these types of load transfer simultaneously would thus provide a redundant and safe attachment for the critical piling to structure underwater connections. The use of the bolted friction pile clamps 117 also eliminates the need for any gripping mechanisms to stop relative movement between the pile sleeves 106 and the piles 115, for the pile grouting procedure during structure installation.

The piling 115, pile sleeves 106 and pile clamps 117 are inclined in the same or nearly the same planes as the main tubular legs 104, and at an angle such that they project to a point 119, above the top of the vertical pipe column 101, for example, forty (40') to seventy (70') feet above the water surface 102. This permits installation of the piling 115 with a drilling rig (not shown) in the same position (location) as that for the installation of the vertical pipe column (well conductor) 101 and the support brace assembly 100.

The pilings 115 are designed to have a soil 103 penetration sufficient to support the completed structure, and may be pre-loaded on the support brace assembly 100 to ease installation. In order to assist with piling (115) installation, two (2) pairs of pile guides 120 are pre-installed on the support brace assembly 100. These guides 120 control pile (115) alignment, the alignment of any pile follower or other installation equipment, and temporarily support the piling 115 and/or pile follower, and are used to support the piling 115 if they are preloaded on the support brace assembly 100.

The pile guides 120 are removed after structure installation. If the piling 115 are pre-loaded, their upper ends are supported in the guides 120, and lower ends in the pile sleeves 106.

The support brace assembly 100 may have a boat landing 121 near water-line 102, either pre-installed rigidly or clamped in temporary position for vertical adjustment after structure installation. The boat landing 121 may be installed after the support brace assembly (100) installation by slipping it over the top of the vertical pipe column 101 and the pipe sleeve 105, or by being fabricated in two (2) halves, which can be clamped around the vertical pipe sleeve 105.

The boat landing 121 provides a convenient work platform for the installation of the connection 122 between the top of the support brace assembly 100 and the vertical pipe column 101, and for the installation of the piling 115.

The connection 122 of the top of the support brace assembly 100 to the vertical pipe column 101 is accomplished with a conventional field-welded shim connection 122 positioned between the top of the pipe sleeve 105 and the vertical pipe column 101. This connection 122 would typically be located, for example, ten (10') to fifteen (15') feet above the water-line 102. This connection may also be reinforced by pumping cement grout into the annulus 123 (see FIG. 2) between the vertical pipe column 101 and the pipe sleeve 105.

Figure 2:
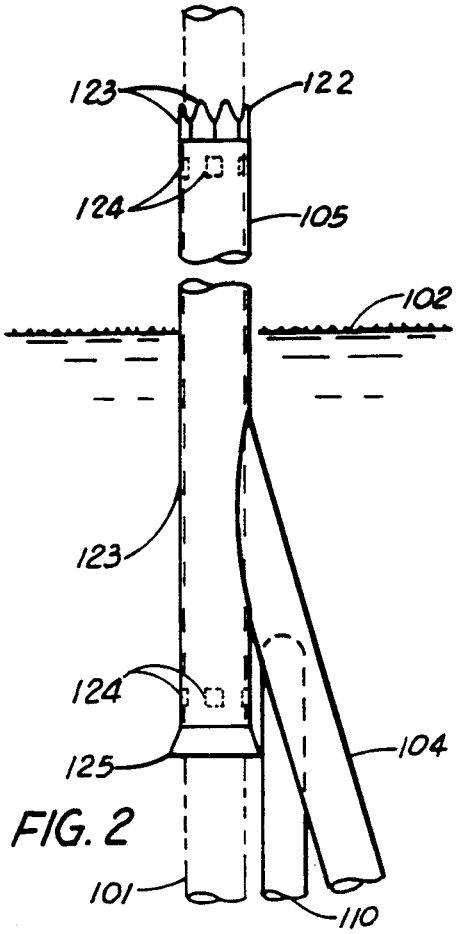
FIG. 2 is an enlarged, detail, side view of the vertical pipe sleeve connection of the support brace assembly to the vertical pipe column, near water-line of the embodiment of FIGS. 1A-1C.

FIG. 2 shows a more detailed side view of the top of the support brace assembly 100. The vertical pipe sleeve 105 has a outside diameter typically six (6") inches larger than the outside diameter of the vertical pipe column 101. Additional features indicated in this figure are the several individual shim plates 123, which are welded to the top of the pipe sleeve 105 and along the side of the vertical pipe column 101, and to each other.

Also indicated are centralizing shim plates 124 preinstalled inside the vertical pipe sleeve 105, near each end, which partially fill the annulus 123 between the pipe sleeve 105 and the vertical pipe column 101. Also indicated is a cone shaped guide 125 at the bottom of the pipe sleeve 105 used to assist the stabbing of the support brace assembly 100 over the top of the vertical pipe column 101.

Figure 3A:
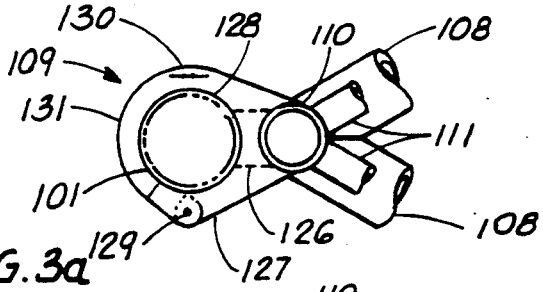
FIG. 3A is an enlarged, detail, plan view of the hinged collar clamp of the support brace assembly at the vertical pipe column, near mid-water depth.
Figure 3B:
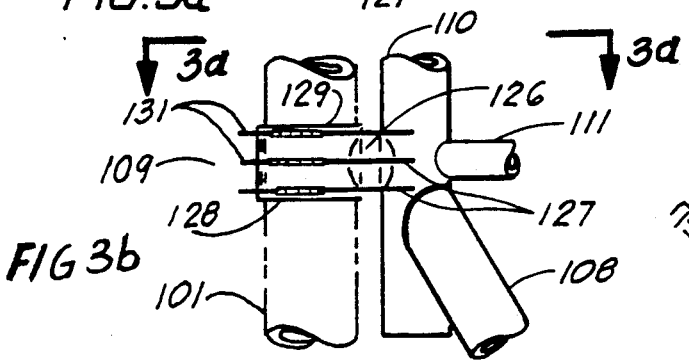
FIG. 3B is an enlarged, detail, side view of the hinged collar clamp shown in FIG. 3A.

More details of the hinged collar clamp 109 are shown in FIG. 3A in a plan view, and in FIG. 3B in a side view. The hinged collar clamp 109 fits around the vertical pipe column 101, and is connected to the vertical tubular member 110 with a short tubular strut 126 and gusset stiffening plates 127.

The clamp 109 is fabricated from a short piece of tubular sleeve 128 with an inside diameter slightly larger [approx. a half (½") to an (1") inch]than the outside diameter of the vertical pipe column 101. This tubular sleeve 128 is split longitudinally into two (2) halves and is equipped with a hinge assembly 129 on one side, and a pair of vertical bolted flanges 130 on the other side.

Stiffening ring plates 131 may reinforce the outside half of the tubular sleeve 128. The hinged collar clamp 109 is installed against the vertical pipe column 101 in the hinge open position, and is closed and bolted with divers after final alignment of the support brace assembly 100 during installation, providing lateral support only to the vertical pipe column 101.

Figure 4A:
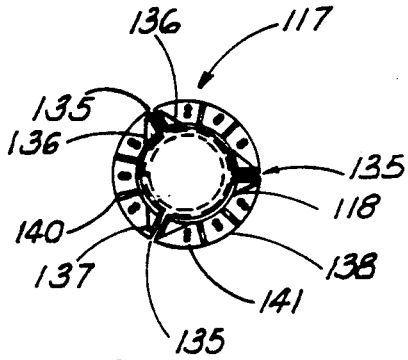
FIG. 4A is an enlarged, detail, plan view of the pile sleeve and bolted friction pile clamp connecting the support brace assembly to one pile of the embodiment of FIGS. 1A-1C.
Figure 4B:
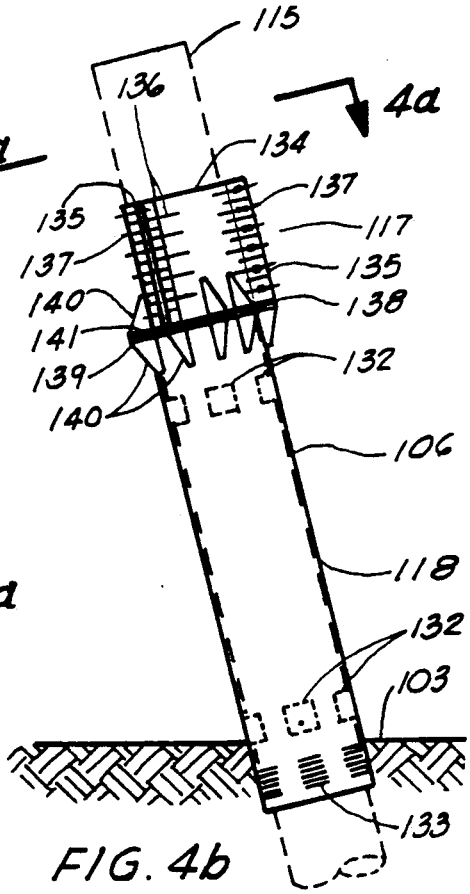
FIG. 4B is an enlarged detail side view of the pile sleeve and clamp shown in FIG. 4A.

More details of a pile sleeve 106, tubular piling 115, and bolted friction pile clamp 117 are shown in FIG. 4A in a plan view, and in FIG. 4B in a side view.

The pile sleeve 106 has an outside diameter typically six (6") inches larger than the tubular piling 115. The pile sleeve 106 is equipped with centralizing shim plates 132 pre-installed inside the pile sleeve 106, near each end, which partially fill the annulus 118 between the pile sleeve 106 and the piling 115. The pile sleeve 106 may also be equipped with a conventional pile wiper/grout seal 133, pre-installed inside and near the bottom of the sleeve 106 in order to seal the annulus 118 from mud 103 intrusion during pile driving, and to permit cement grouting of the sleeve/piling annulus 118.

The bolted friction pile clamp 117 is used to make a rigid mechanical connection between the piling 115 and the top of pile sleeve 106. The clamp 117 is fabricated from a short segment of tubular sleeve 134 with an inside diameter equal to the outside diameter of the piling 115.

This tubular sleeve 134 is split longitudinally into three (3) equal segments and is equipped with pairs of vertical bolted flanges 135 at each of the three (3) seams. Each pair of vertical bolted flanges 135 are spaced two (2") to four (4") inches apart, face to face, and are stiffened with gusset plates 136 as required.

A sufficient number and size of horizontal bolts 137 are located in horizontally slotted holes such that, when the bolts 137 are drawn up and properly tightened, with the inside of the pile clamp 117 firmly clamped against the outside of the pile 115, the clamping force is sufficient to transfer pile (115) loads to the pile clamp 117 by friction. The bolted friction pile clamp 117 is in turn connected to the top of the pile sleeve 106 using a circular horizontal bolted flange, cut into three equal segments, welded to the bottom of each segment of the clamp tubular sleeve 134.

A matching circular horizontal flange 139, not cut, is located on the top of the pile sleeve 106. The flange plates 138 and 139 are stiffened with gusset plates 140 as required. A sufficient number and size of vertical bolts 141 are located in slotted holes such that, when the bolts 141 are properly tightened, they are capable of transferring pile (115) loads from the bolted friction pile clamp 117 to the top of the pile sleeve 106.

The splitting of the pile clamp 117 into equal thirds, and the slotting of holes for the horizontal and vertical bolts 137 and 141, are designed to permit the pile clamp 117 to be pre-installed on the top of the pile sleeve 106 such that each segment is retracted radially outward from the piling 115, allowing the pile 115 to be driven through the pile clamp 117 without interference. Once the piling 115 is driven to full penetration into the soil 103, the pile clamp 117 segments are pulled radially inward against the piling 115 by tightening the horizontal bolts 137, and then the vertical bolts 141 are tightened to complete the friction bolted pile clamp 117 connection.

Figure 5:
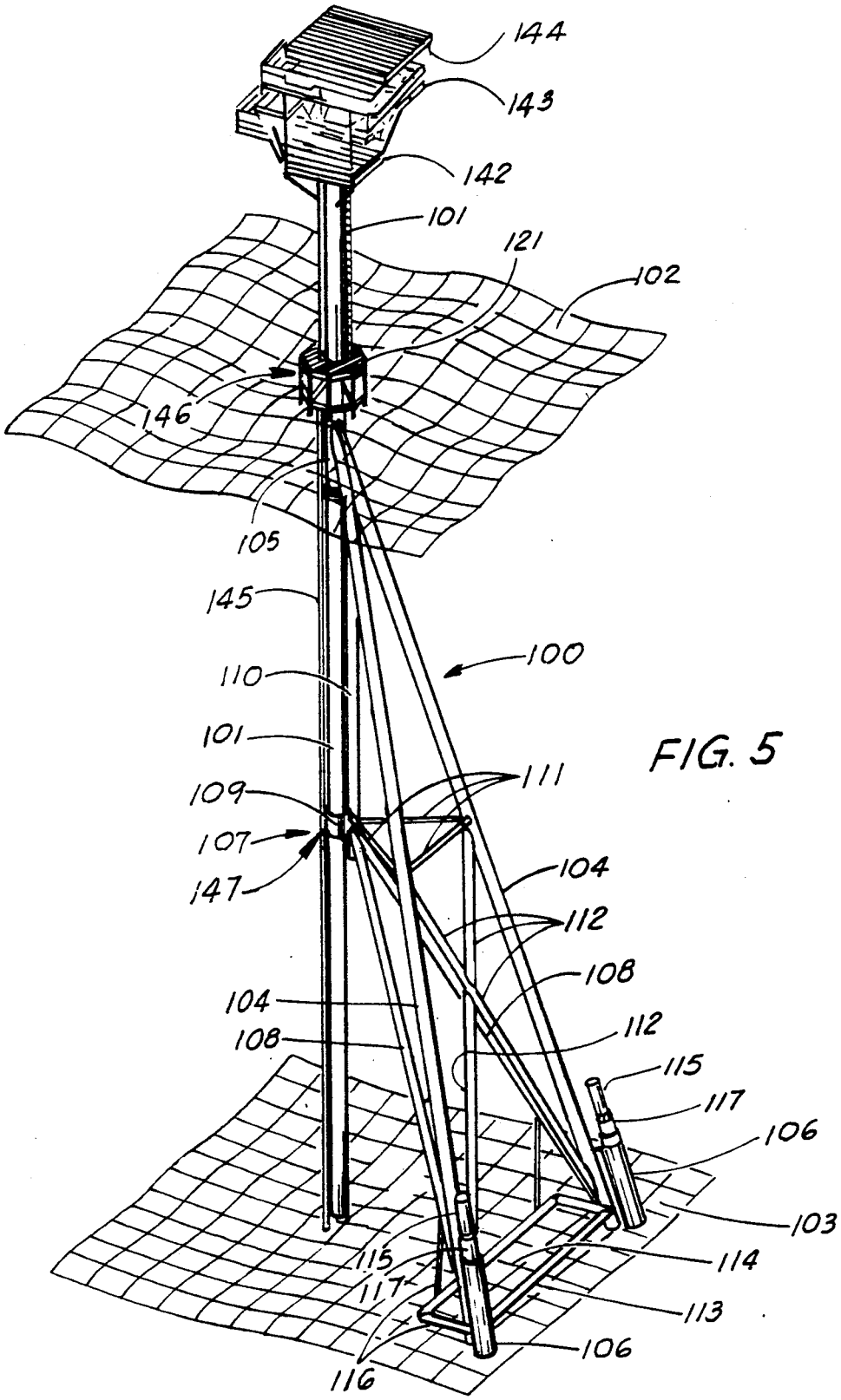
FIG. 5 is an perspective view of the structure shown in FIGS. 1 through 4, illustrating also the support of a platform and helideck, and one additional vertical pipe column (well conductor).

FIG. 5 shows a perspective view of a completed application of the present invention in its initial preferred embodiment. In this case, the structure is shown supporting an extension of the vertical pipe column (well conductor) 101, which in turn supports a wellhead deck 142, an equipment deck 143, and a helideck 144, with associated equipment, stairs, ladders, railing, etc. The structure could also be used to support other types and applications of upper platforms, as well as to simply function as a support and protector for the vertical pipe column 101.

This perspective view, FIG. 5, also shows support of one (1) additional vertical pipe column (well conductor) 145, parallel and adjacent to the main vertical pipe column 101, using a guide 146 at the boat landing 121 level, and a guide 147 at the hinged collar clamp 109 level. These guides, 146 and 147, provide only horizontal (lateral) support to the additional pipe column 145, with vertical support being provided by driving the column 145 into the bottom soils 103. Up to three (3) additional vertical pipe columns can be supported conveniently by the completed structure invention. General features of the invention, in addition to those discussed above, are that the structure has relatively few members, leading to simplified fabrication and installation. It uses standard construction materials and tubular diameters.

Certain components of the support brace assembly 100, such as the vertical pipe sleeve 105, boat landing 121, hinged collar clamp 109, pile sleeves 106, bolted friction pile clamps 117, and mudmat 114, may be prefabricated even before the water depth of the ultimate installation is determined, permitting quick structural assembly while the drilling rig is still on location drilling a well. The completed structure has a minimum of surface area in the zone around and immediately above the waterline 102, reducing the amount of lateral load caused by storm wind and waves, thus permitting easier design for severe environmental conditions offshore.

The present invention also includes a method of installation of the above described embodiment, as shown in side views in FIGS. 6A through 6H. This method is specifically suited for installation by a jack-up type drilling rig, not shown in the figures, but could also be applied with a small to moderate sized derrick barge.

Figure 6A:
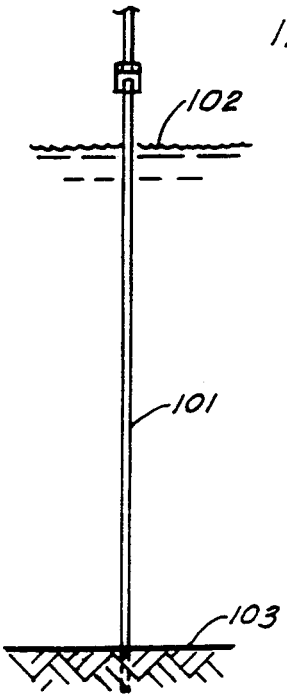
FIGS. 6A through 6H illustrate side views of an installation method for the structure shown in FIGS. 1 through 5.

FIG. 6A shows a vertical pipe column 101 being driven or otherwise disposed into bottom soil 103 in a body of water 102. The pipe column 101 is completed to a point 10' to 15' above the water-line 102.

Figure 6B:
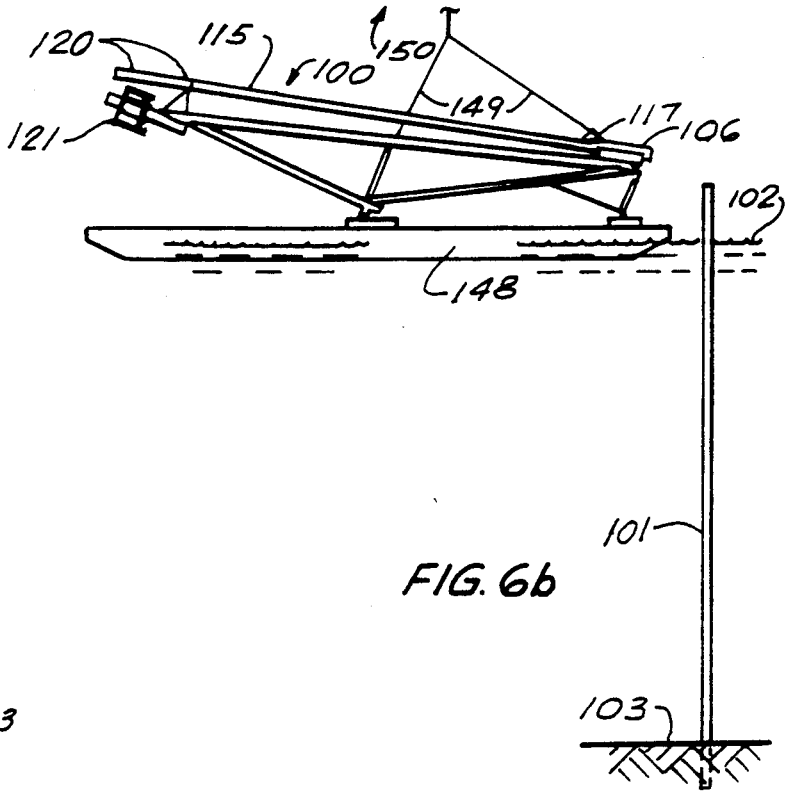

In FIG. 6B, the vertical pipe column 101 free-stands temporarily, or may be temporarily braced to the drilling rig, or other installation equipment. The prefabricated support brace assembly 100, here shown with the pre-loaded boat landing 121, piling 115, and pile clamps 117, is transported to the offshore site on a cargo barge 148. It should be noted that the two (2) piling 115 are supported temporarily in the pile sleeves 106 at the bottom end, and in the temporary pile guides 120 at the top end.

The support brace assembly 100 is transported on its side in order to permit bringing it and the cargo barge 148 under the main derrick block 150 of the drilling rig (not shown). The support brace assembly 100 is lifted by the drilling rig, the barge 148 is removed, and the brace assembly 100 is set into the water. The slings 149 for this lift may be pre-installed on the structure.

Figure 6C:
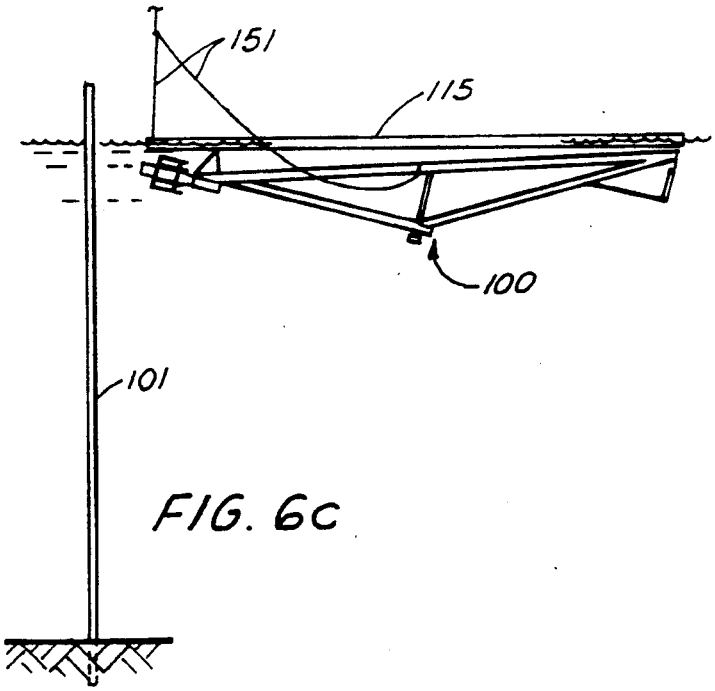

FIG. 6C shows that, as the support brace assembly 100 is set in the water 102, buoyancy provided by the various closed tubular members, including portions or all of the pre-installed piling 115, causes it to float. The support brace assembly 100 is re-rigged while floating to slings 151 near its upper end. These slings 151 may also have been pre-installed.

Figure 6D:
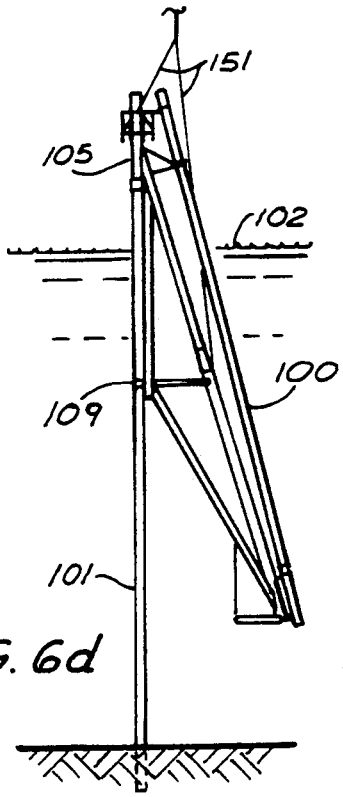

With re-rigging complete, certain tubular members near the bottom of the support brace assembly 100 are allowed to fill with water. This overcomes buoyancy and causes the bottom end of the brace assembly 100 to sink, as shown in FIG. 6D. At the same time, the top end of the brace assembly 100 is lifted out of the water 102 using slings 151. The structure thus self-uprights.

By controlled member flooding and weight distribution, the support brace assembly 100 is brought to proper vertical alignment adjacent to the vertical pipe column 101, with the hinged collar clamp 109 open against the pipe column 101, and the bottom end of the vertical pipe sleeve 105 over the top end of the vertical pipe column 101. The support brace assembly 100 is then lowered over the vertical pipe column 101, and then the hinged collar clamp 109 is closed using divers.

Figure 6E:
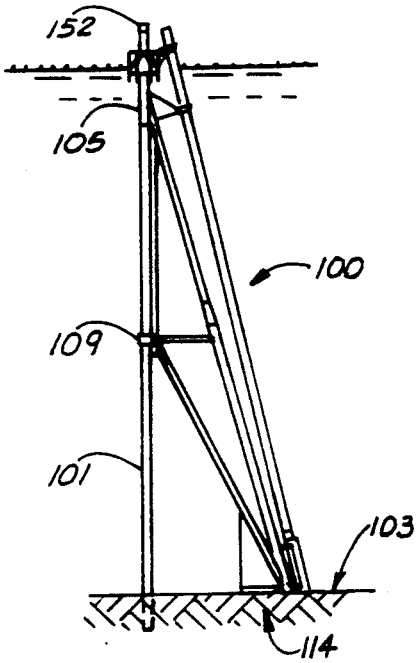

The brace assembly 100 is then lowered further until the mudmat 114 rests on the bottom soil 103, as shown in FIG. 6E. The top end of the vertical pipe sleeve 105 should be below the top of the vertical pipe column 101, and after adjustment of structure plum and orientation, a temporary connection 152 may be made at this location.

Figure 6F:
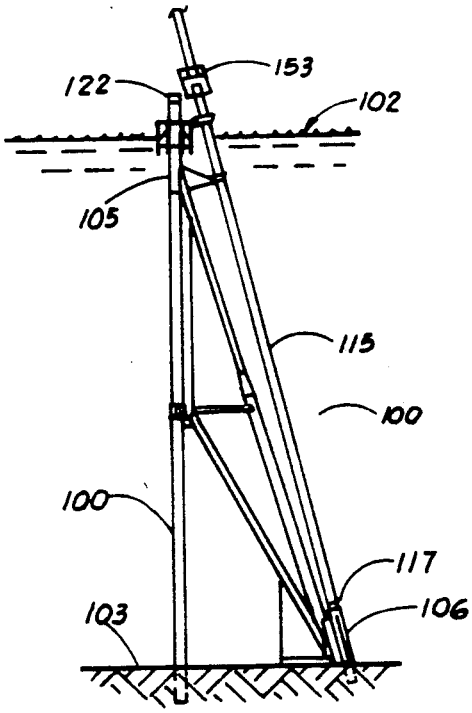

Next, as shown in FIG. 6F, the two piling 115 are driven or otherwise disposed into the soil bottom 103 using a conventional pile driving hammer 153 with pile followers, or by other means. The jack-up drilling rig is able to accomplish this procedure without repositioning.

Once the piling 115 are driven to full penetration, the bolted friction pile clamps 117 are tightened around the pilings 115, and to the top of the pile sleeves 106, using divers. After final plumbing and adjustment of the structure, the conventional welded shim plate connection 122 between the top of the vertical pipe sleeve 105 and the pipe column 101, should be installed. With this complete, cement grouting of the annulus between the piling 115 and the pile sleeves 106 may proceed, using diver assistance.

Figure 6G:
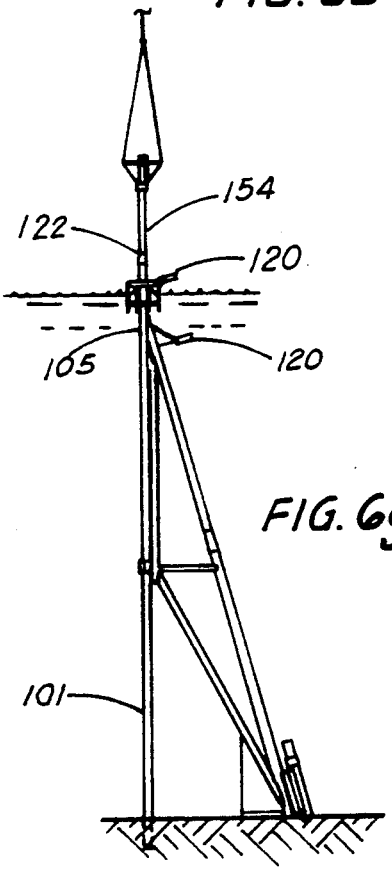

FIG. 6G shows the erection by conventional means of any extension of the vertical pipe column 154, or other supported structure or platform, using the drilling rig or other installation equipment. The annulus between the vertical pipe sleeve 105 and the pipe column 101 may also be filled with cement grout, if desired or required.

Figure 6H:
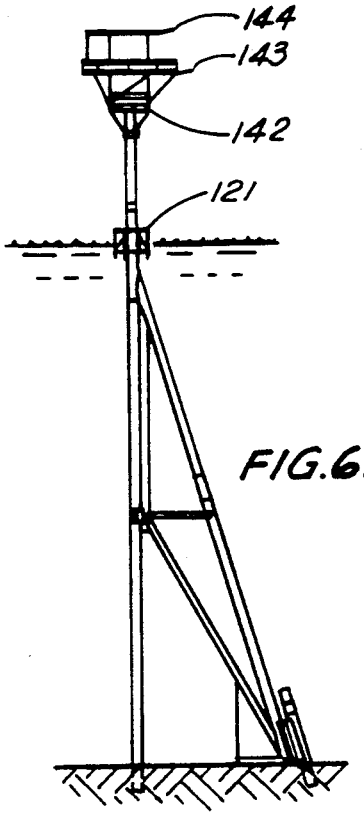

The remainder of the structure may now be installed, as shown in FIG. 6H, with upper decks 142 and 143, helideck 144, and permanently installed boat landing 121. Any temporary pile support guides 120 are removed, as well as any other installation aids, slings, etc. Platform installation is thus completed.

Removal of the present invention at the end of its use in its initial location can be accomplished also with a jack-up type drilling rig, or small derrick barge. The use of a drilling rig, otherwise required to plug and abandon a depleted well(s), could lead to significant cost savings.

A method similar, though in reverse, of the above described installation procedure, could be utilized, as described below:

(a) Mobilize the jack-up drilling rig, set up at the site over the existing well(s), and proceed to plug and abandon the well(s).

(b) Remove any existing helideck deck, or other platform equipment.

(c) Cut the existing two (2) piling below soil bottom, by explosives or other means.

(d) Rig the support brace assembly for lift, and cut the connection of the top of the support brace assembly to the vertical pipe column, open the hinged collar clamp, and lift the brace assembly off of the pipe column.

(e) Temporary flotation devices or other means can be used to float the support brace assembly structure, re-rig it, and lift it on to a cargo barge.

(f) Cut the existing vertical pipe column below the soil bottom, by explosives or other means.

(g) Rig, lift, and remove the pipe column.

Once the components of the subject invention are removed, they may easily be re-used in a different, but similar water depth location, or relatively easily modified for use in a different water depth.

Figure 9:
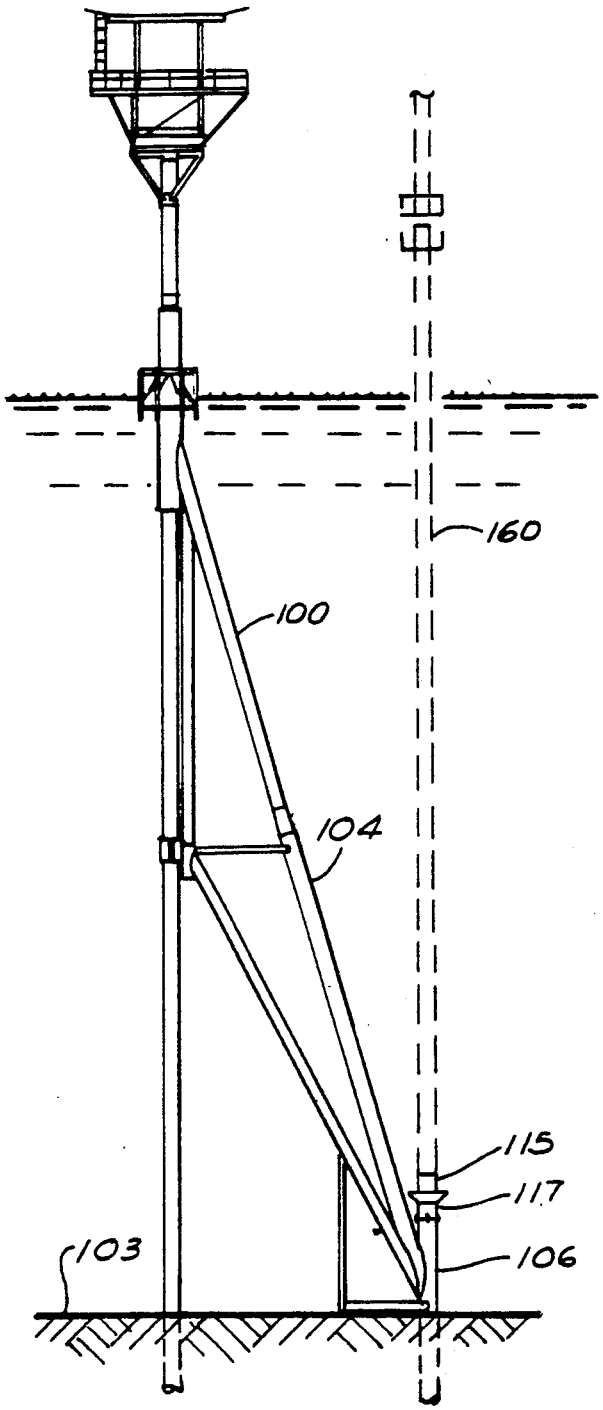
FIG. 9 is a side view of a single tiered embodiment of the present invention illustrating the placement and installation of the piles through the pile sleeves and further illustrating an alternate design in the bracing members.
Figure 10:
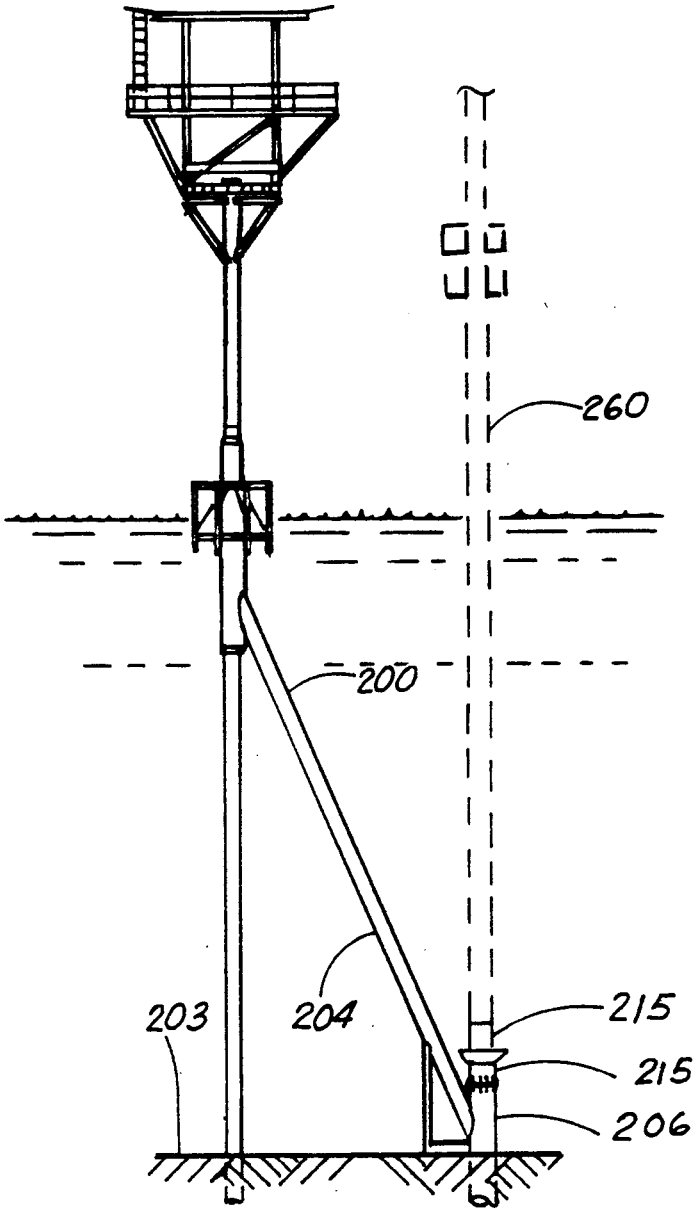
FIG. 10 is a side view of a single tiered embodiment of the present invention illustrating the placement and installation of the piles through the pile sleeves and further illustrating an alternate design in the bracing members.

A final alternate embodiment of the present invention is illustrated in FIGS. 9 and 10. Both the preferred embodiment structure, with mid-depth hinged collar clamp to form a "two-tiered" structure, and the alternate embodiment "single tiered" structure for shallower water, may be installed, as indicated above, with a small derrick barge or jack-up work boat with crane.

These installation vessels might be preferred over a jack-up drilling rig if drilling rig costs or availability are a problem, and also if a mud-line suspension well or a completed well conductor pipe extending above the water-line already exist. In such cases, the configuration of certain components of the present invention may be modified to suit the particular installation equipment and/or procedure.

Figure 7:
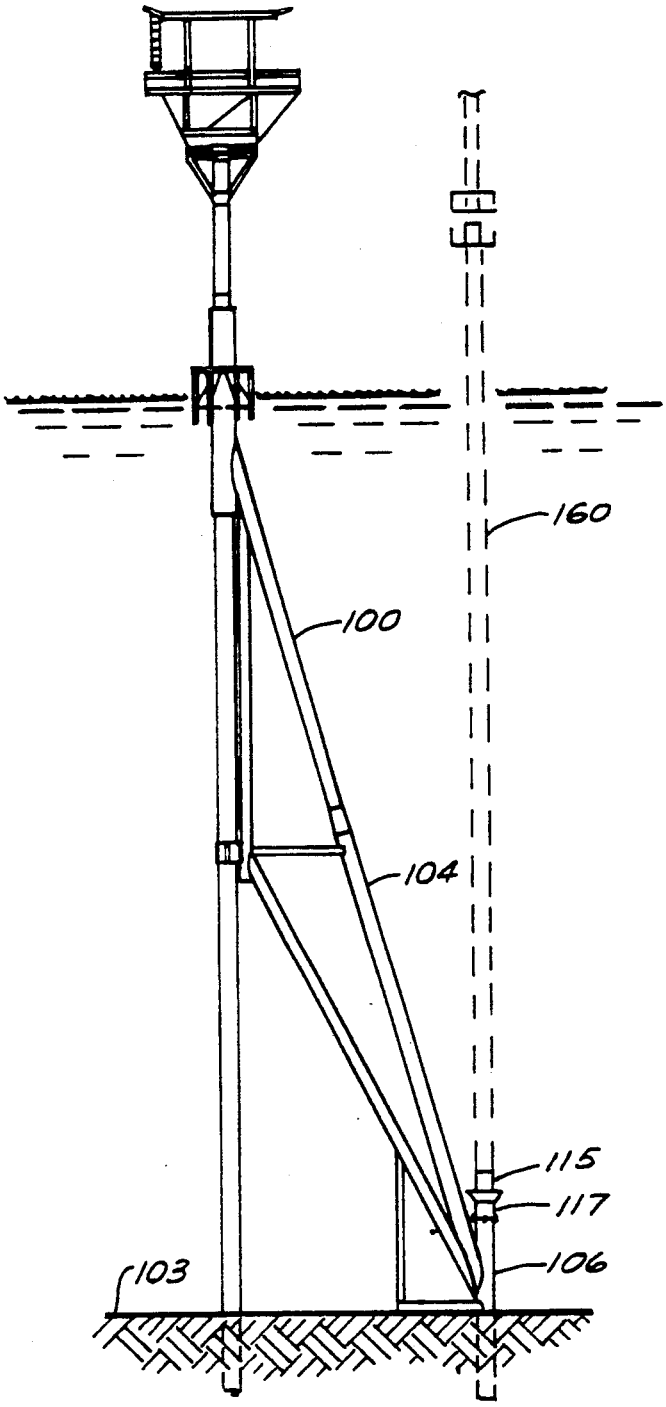
FIG. 7 is a side view of an alternate embodiment of the invention shown in FIGS. 1 through 5, but with vertical piles, pile sleeves and pile clamps.
Figure 8:
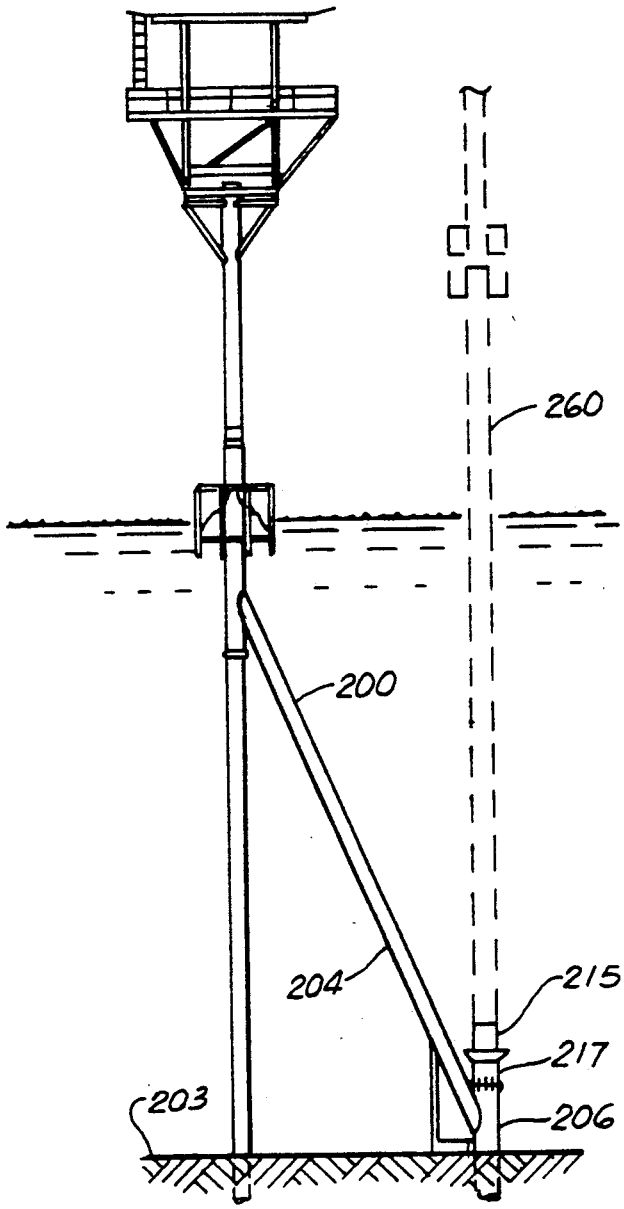
FIG. 8 is a side view of a single-tiered embodiment of the invention, but with vertical piles, pile sleeves and pile clamps.

A significant major modification, as seen in FIGS. 9 and 10, could be the use of vertical pile sleeves 106 (206), piling 115 (215), and pile clamps 117 (217) at the mud-line 103 (203) support of the support brace assembly 100 (200), in lieu of inclined pile sleeves as described in the preferred and alternate ("single-tiered") embodiment. This modification may be advantageous if non-preloaded vertical piling 115 (215) are anticipated, to be driven with a conventional hammer and pile follower 160 (260), or underwater hammer (not shown). This modification also would simplify the main tubular leg 104 (204) to the pile sleeve 106 (206) connections, eliminating the need for an offset type connections at these locations, and would not require temporary pile guides 120 (220). (See FIGS. 1B and 7B.)

Other aspects of this alternate embodiment of the invention would be similar to the previously described embodiments.

The embodiments described herein in detail for exemplary purposes are of course subject to many different variations in structure, design, application and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

What is claimed is:

1. A method of utilizing a support brace assembly for supporting a somewhat vertical, at least partially submerged, main pipe column extending substantially up from below the mudline, the main pipe column having an upper end, an intermediate area, and a lower end, comprising the following steps:

a. utilizing a support brace assembly configured to be installed in body of water, and having an upper end, an intermediate area, and a lower end, said support brace assembly further including vertical pipe sleeve member rigidly forming said upper end of said support brace assembly, said vertical pipe sleeve member being of sufficient diameter to slidingly envelope the main pipe column, stabilizing the upper end of the main pipe column, ground support base forming said lower end of said support brace assembly, said ground support base further including first and second inclined and radially spaced pile sleeves, first and second, inclined, radially spaced, primary support legs having upper and lower ends, said upper end of said first and second primary support legs being rigidly affixed to said vertical pipe sleeve member, said lower end of said first primary support leg to be in communication with said first pile sleeve, said lower end of said second primary support leg to be in communication with said second pile sleeve, and intermediate support means for stabilizing the intermediate area of the main pipe column, said intermediate support means further including a hinged collar clamp configured to envelope the intermediate area of said main pipe column, first and second inclined, radially spaced, intermediate tubular braces having upper and lower ends, said upper ends of said intermediate tubular braces to be affixed to said hinged collar clamp, said lower end of said first intermediate tubular brace to be in communication with said lower end of said first primary support leg, said lower end of said second intermediate tubular brace to be in communication with said lower end of said second primary support leg, a vertical brace joining said hinged collar clamp to said upper end of said first and second primary support legs, & a horizontal brace assembly joining said hinged collar clamp to said intermediate area of said first and second primary support legs;

b. sealing said intermediate tubular braces to prevent the migration of water therein;

c. transporting the support brace assembly to the installation site;

d. lifting the support brace assembly;

e. lowering the support brace assembly to the surface of the water;

f. selectively unsealing said intermediate tubular braces, allowing migration of water therein, causing said lower ends of said braces to begin to sink;

continuing to selectively unseal said intermediate tubular braces, allowing migration of water therein, causing the support brace assembly to self-upright into a substantially vertical position;

h. directing said vertical pipe sleeve member over the top of said main pipe column, allowing it to slidingly engage said main pipe column in a downward fashion;

i. directing said hinged collar clamp loosely about the intermediate area of said main pipe column;

j. adjusting said hinged collar clamp in vertical fashion about the main pipe column to the desired area, and tightening said hinged collar clamp to envelope the main pipe column;

k. lowering said support brace assembly further until said pile sleeves are in communication with the bottom soil;

l. installing first and second pilings into the mud-line through said first and second piling sleeves;

m. connecting said first and second pile sleeves to said first and second piles, respectively; and n. connecting said vertical pipe sleeve member to the main pipe column.

2. The method of claim 1, wherein in step "a" there is further included the step of prefabricating said support brace assembly.

3. The method of utilizing a support brace assembly of claim 2 wherein there is further included the steps of:

i. fabricating a platform structure; and ii. affixing the platform structure to the main pipe column.

* * * * *